US010355374B2

(12) United States Patent
Kitamura et al.

(10) Patent No.: US 10,355,374 B2
(45) Date of Patent: Jul. 16, 2019

(54) TERMINAL FITTING

(71) Applicant: Sumitomo Wiring Systems, Ltd., Yokkaichi, Mie (JP)

(72) Inventors: Keishi Kitamura, Mie (JP); Naotaka Tanikawa, Mie (JP); Takuya Masumoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/019,599

(22) Filed: Jun. 27, 2018

(65) Prior Publication Data

US 2019/0013594 A1 Jan. 10, 2019

(30) Foreign Application Priority Data

Jul. 5, 2017 (JP) ..... 2017-131904

(51) Int. Cl.

| | |
|---|---|
| ***H01R 11/11*** | (2006.01) |
| ***H01R 13/11*** | (2006.01) |
| ***H01R 13/115*** | (2006.01) |
| ***H01R 4/18*** | (2006.01) |
| *H01R 43/16* | (2006.01) |

(52) U.S. Cl.

CPC ..... *H01R 4/185* (2013.01); *H01R 11/11* (2013.01); *H01R 13/113* (2013.01); *H01R 13/115* (2013.01); *H01R 4/188* (2013.01); *H01R 43/16* (2013.01)

(58) Field of Classification Search

CPC ..... H01R 4/185; H01R 4/188; H01R 11/11; H01R 13/11; H01R 13/113; H01R 13/4223; H01R 13/432; H01R 43/16

See application file for complete search history.

(56) References Cited

U.S. PATENT DOCUMENTS 5,788,542 A * 8/1998 Miwa ..... H01R 13/113 439/851
6,152,788 A * 11/2000 Hata ..... H01R 13/113 439/51
6,227,915 B1 * 5/2001 Sakatani ..... H01R 13/11 439/752.5

(Continued)

FOREIGN PATENT DOCUMENTS

JP 5-53146 7/1993

*Primary Examiner* — Edwin A. Leon
*Assistant Examiner* — Oscar C Jimenez
(74) *Attorney, Agent, or Firm* — Gerald E. Hespos; Michael J. Porco; Matthew T. Hespos

(57) ABSTRACT

A terminal fitting (1) includes a rectangular tube (11) with a bottom wall (12), two side walls (13A, 13B) rising from the bottom wall (12) and a ceiling wall (15) facing the bottom wall (12). The rectangular tube (11) includes a terminal insertion opening (17) on one end, and a tab (T) is insertable therein. A resilient contact piece (21) is arranged along the bottom wall (12) inside the rectangular tube (11). Two protection walls (31A, 31B) extend respectively from the side walls (13A, 13B) to close the terminal insertion opening (17), leaving a clearance for entrance of the tab (T) between the ceiling wall (15) and the protection walls. The protection walls (31A, 31B) have facing edges (35A, 35B) facing the mating protection walls (31B, 31A), and the facing edges (35A, 35B) extend obliquely with respect to a line (L) perpendicular to the bottom wall (12).

3 Claims, 6 Drawing Sheets

(56) References Cited

U.S. PATENT DOCUMENTS

| | | | | |
|---|---|---|---|---|
| 6,290,554 | B1 * | 9/2001 | Makita | H01R 13/11 439/852 |
| 7,004,797 | B2 * | 2/2006 | Harada | H01R 4/185 439/852 |
| 8,523,619 | B2 * | 9/2013 | Itou | H01R 13/113 439/852 |
| 8,821,197 | B2 * | 9/2014 | Muro | H01R 13/113 439/830 |
| 8,858,274 | B2 * | 10/2014 | Jakoplic | H01R 13/11 439/843 |
| 9,039,447 | B2 * | 5/2015 | Aoki | H01R 13/428 439/607.01 |
| 9,716,331 | B2 * | 7/2017 | Sasaki | H01R 13/113 |
| 9,787,005 | B2 * | 10/2017 | Bluemmel | H01R 4/18 |
| 2004/0157503 | A1 * | 8/2004 | Fujii | H01H 85/2035 439/856 |
| 2005/0227551 | A1 * | 10/2005 | Tabata | H01R 13/113 439/852 |
| 2005/0250356 | A1 * | 11/2005 | Matsumura | H01R 12/585 439/82 |
| 2014/0004756 | A1 * | 1/2014 | Sakamoto | H01R 4/16 439/877 |
| 2014/0349521 | A1 * | 11/2014 | Sakamoto | H01R 31/08 439/626 |
| 2016/0056575 | A1 * | 2/2016 | Morello | H01R 13/6275 439/352 |
| 2018/0226737 | A1 * | 8/2018 | Kitamura | H01R 13/11 |

* cited by examiner

TERMINAL FITTING

BACKGROUND

Field of the Invention

This specification relates to a terminal fitting.

Description of the Related Art

Japanese Utility Model Publication No. H05-53146 discloses a socket contact with a pin contact receiving portion in the form of a rectangular tube and a spring contact portion arranged inside the pin contact receiving portion. Two protection walls are provided on the front end of the pin contact receiving portion for protecting the resilient contact piece. The protection walls close an opening of the pin contact receiving portion but leave a clearance capable of receiving a pin contact. However, the protection walls may not protect the resilient contact piece sufficiently if the protection walls are deformed by an external force.

SUMMARY

A terminal fitting disclosed by this specification is to be connected to a mating terminal fitting with a tab. The terminal fitting includes a rectangular tube composed of a bottom wall, two side walls rising from the bottom wall and a ceiling wall continuous from at least one of the side walls and facing the bottom wall. The rectangular tube has an opening on one end, and the tab is insertable into the opening. A resilient contact piece in the form of a leaf spring is arranged along the bottom wall inside the rectangular tube. Two protection walls extend from the side walls and close the opening while leaving a clearance for allowing the tab to enter between the ceiling wall and the protection walls. The protection walls have opposed facing edges. Each facing edge has a part extending at an angle to a line perpendicular to the bottom wall.

External matter that hits the rectangular tube from the bottom exerts an external force on the protection walls in a direction from the bottom wall toward the ceiling wall and in a direction to deform the protection walls from the bottom wall toward the ceiling wall. However, the facing edges of the protection walls are at an angle to the line perpendicular to the bottom wall. Thus, the facing edge of one protection wall interferes with the facing edge of the other protection wall. In this way, the resilient contact piece is protected reliably by suppressing deformation of the protection walls against the external force applied in the direction from the bottom wall toward the ceiling wall.

The facing edge may be inclined obliquely with respect to the line perpendicular to the bottom wall over an entire length. According to this configuration, the deformation of the protection walls can be suppressed by simple shapes and the complication of a manufacturing process can be avoided.

A part of the facing edge on the ceiling wall side and a remaining part on the bottom wall side may be inclined in opposite directions with respect to the line perpendicular to the bottom wall. According to this configuration, a chevron-shaped part of one protection wall is fit into a valley-shaped part of the other protection wall. Thus, deformation of the protection walls can be restricted reliably.

Accordingly, the terminal fitting disclosed in this specification reliably protects a resilient contact piece by suppressing deformation of protection walls.

DETAILED DESCRIPTION

Figure 1:
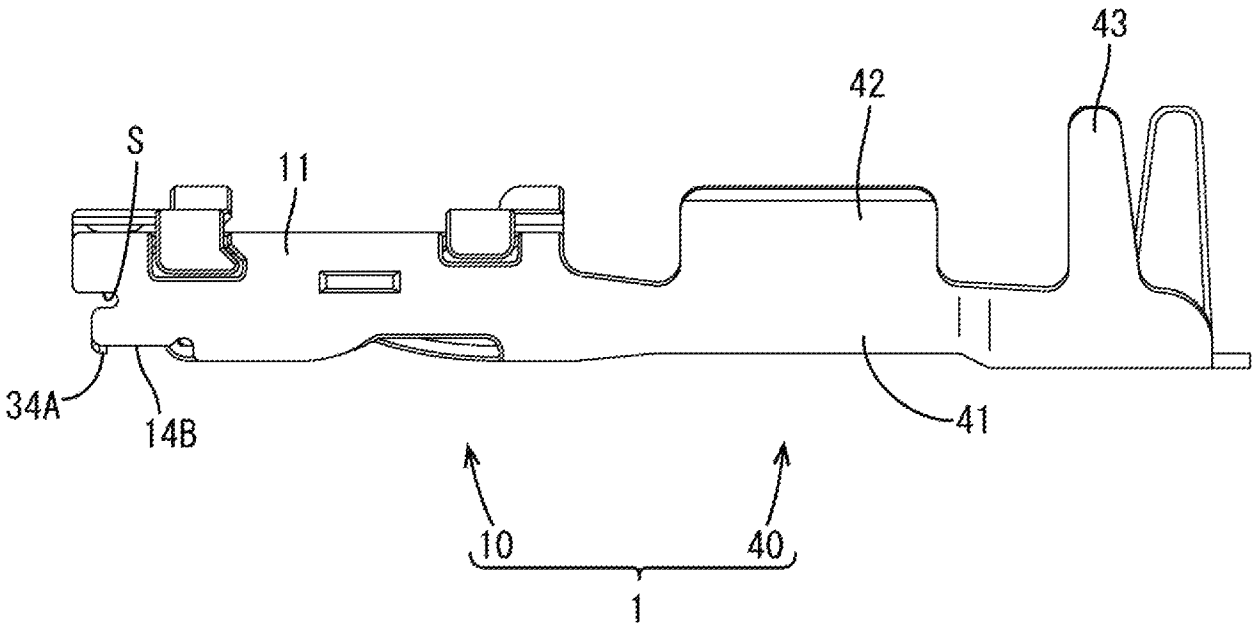
FIG. 1 is a side view of a terminal fitting of an embodiment.

A female terminal fitting in accordance with the invention is identified by the numeral 1 in FIGS. 1 to 4 and is formed by stamping and bending a metal plate material. As shown in FIG. 1, the terminal fitting 1 includes a body 10 and a connecting portion 40 continuous from the body 10 and to be connected to an end of a wire.

The body 10 includes a rectangular tube 11 configured to receive a tab T of the male terminal fitting inside. A resilient contact piece 21 is disposed inside the rectangular tube 11 and is configured to contact the tab T of the male terminal fitting. First and second protection walls 31A, 31B extend integrally from the rectangular tube 11 and are configured to protect the resilient contact piece 21.

Figure 2:
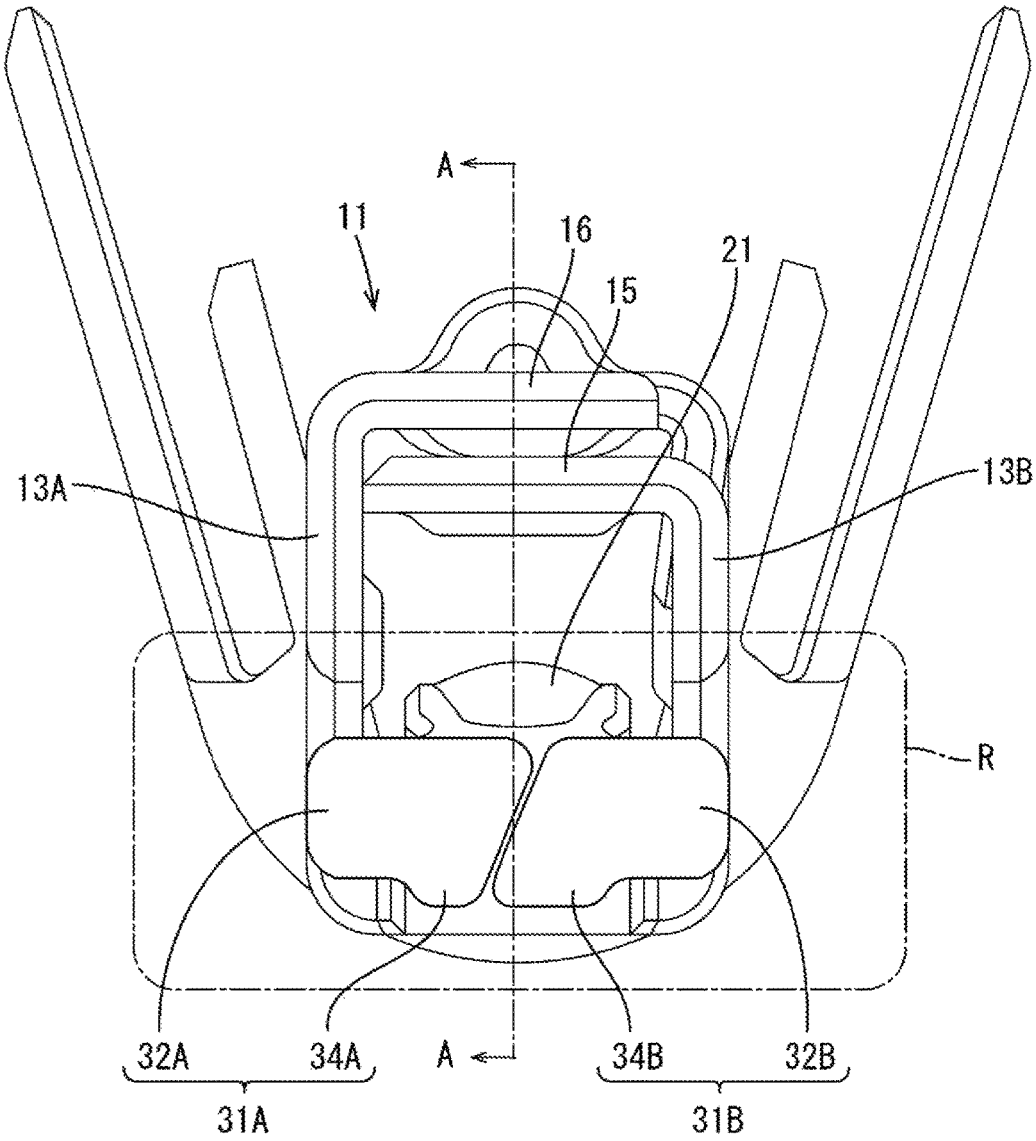
FIG. 2 is a front view of the terminal fitting of the embodiment.
Figure 3:
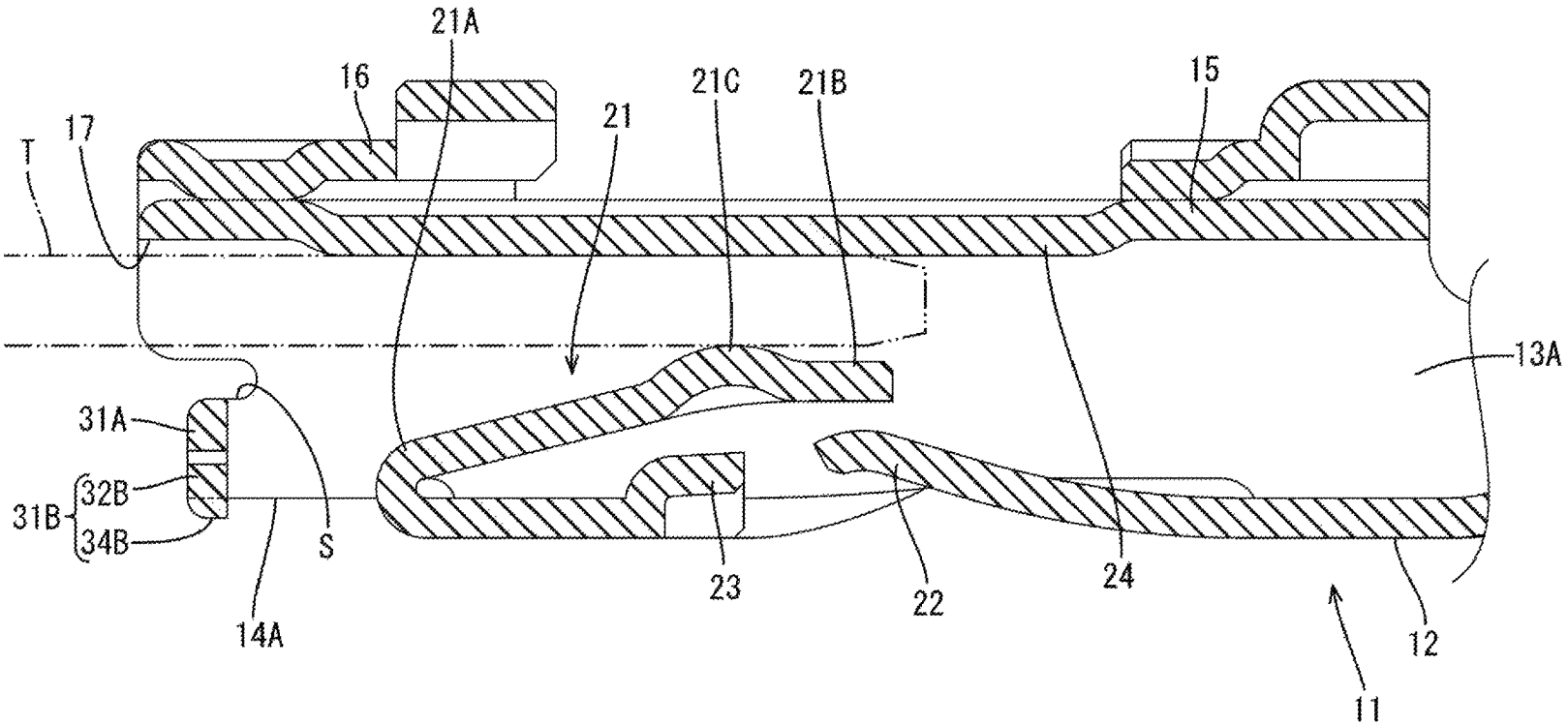
FIG. 3 is a section along A-A of FIG. 2.

As shown in FIGS. 2 and 3, the rectangular tube 11 is open on both ends, and includes a bottom wall 12, first and second side walls 13A, 13B and a ceiling wall 15. The bottom wall 12 is a long narrow plate. Each of the side walls 13A, 13B is a long narrow plate rising perpendicularly from the respective sides of the bottom wall 12 so that the side walls 13A, 13B face each other. The ceiling wall 15 is a long narrow plate-like part that extends from the second side wall 13B toward the first side wall 13A and faces the bottom wall 12. A locking wall 16 extends from the first side wall 13A toward the second side wall 13B to overlap on an outer surface of the ceiling wall 15.

As shown in FIG. 3, the bottom wall 12 is shorter than the side walls 13A, 13B and ceiling wall 15 in one end of the rectangular tube 11 (left part of FIG. 3), and the other three walls 13A, 13B, 15 extend farther than the leading end edge of the bottom wall 12 in a direction toward a tip (left of FIG. 3). Thus, each of the side walls 13A, 13B includes a lower edge 14A, 14B (lower side of FIGS. 1 and 3) extending from the leading end of the bottom wall 12 to the leading end of the side wall 13A, 13B. The opening in this end part of the rectangular tube 11 defines a terminal insertion opening 17 into which the tab T of the male terminal fitting is inserted as shown in FIG. 3.

As shown in FIG. 3, the resilient contact piece 21 is a leaf spring arranged inside the rectangular tube 11 and extending along the bottom wall 12. The resilient contact piece 21 has a base 21A curved from the leading end of the bottom wall 12 on the side of the terminal insertion opening 17 to be folded into the rectangular tube 11, and also has a free end 21B opposite the base 21A.

Most of the resilient contact piece 21 on a side near the base 21A is gently separated from the bottom wall 12 with distance from the base 21A, and a remaining part near the free end 21B extends parallel to the bottom wall 12 so that the resilient contact piece 21 has a chevron shape. A dome-shaped contact 21C is arranged on a top part of the chevron shape and bulges toward the ceiling wall 15 to contact the tab T.

As shown in FIG. 3, the bottom wall 12 includes an auxiliary spring piece 22 configured to assist the resilient contact piece 21 and an excessive deflection preventing portion 23 configured to prevent excessive deflection of the resilient contact piece 21.

The auxiliary spring piece 22 is a leaf spring formed by cutting and bending a part of the bottom wall 12 inward and contacts the free end part 21B of the resilient contact piece 21 from outside. If the resilient contact piece 21 is deflected and deformed to approach the bottom wall, the auxiliary spring piece 22 is pressed by the resilient contact piece 21 and both are deflected and deformed. Thus, resilient restoration of the resilient contact piece 21 is assisted by a resilient restoring force of the auxiliary spring piece 22.

A part of the bottom wall 12 facing the contact 21C projects inward (toward the resilient contact piece 21), and this projecting part serves as the excessive deflection preventing portion 23. If the resilient contact piece 21 is going to be deflected excessively, the resilient contact piece 21 contacts the excessive deflection preventing portion 23, thereby preventing any further deflection thereof.

A part of the ceiling wall 15 facing the resilient contact piece 21 bulges in, as shown in FIG. 3, to define a pressure receiving portion 24 configured to ensure a contact pressure with the tab T by sandwiching the tab T between the contact 21C and the pressure receiving portion 24.

As shown in FIGS. 1 and 3, each of the two side walls 13A, 13B includes a slit S extending parallel to the bottom wall 12 and the ceiling wall 15 at a substantially middle position between the bottom wall 12 and the ceiling wall 15.

As shown in FIGS. 2 and 3, the protection walls 31A, 31B are plates extending from the rectangular tube 11 and close a substantially half of the terminal insertion opening 17 on the side of the bottom wall 12, leaving a clearance for allowing the entrance of the tab T between the ceiling wall 15 and the protection walls 31A, 31B.

Figure 4:
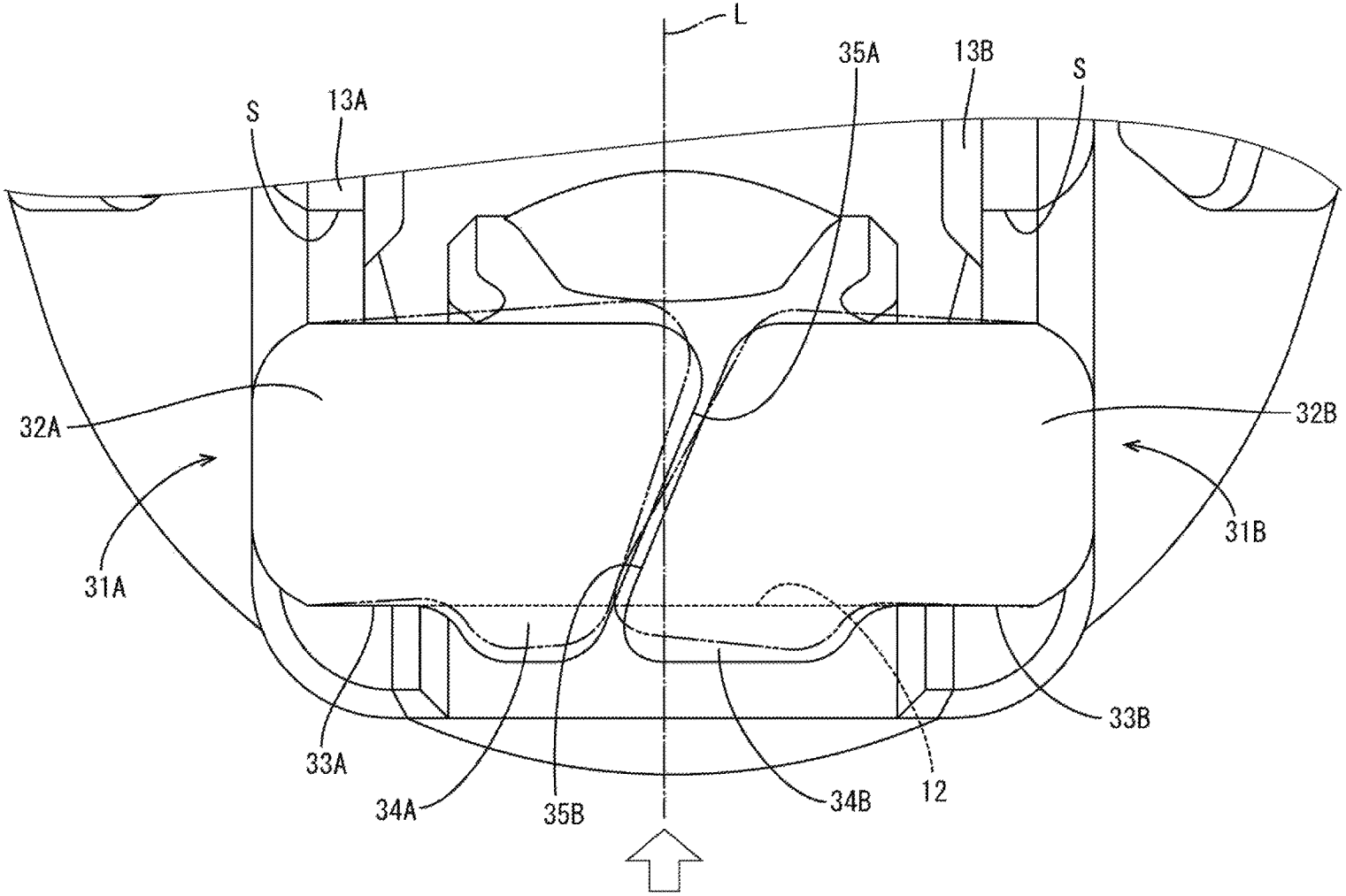
FIG. 4 is an enlarged view of the inside of a circle R of FIG. 2.

As shown in FIGS. 2 and 4, the first protection wall 31A includes a protection wall body 32A and a projection 34A continuous from the protection wall body 32A. The protection wall body 32A is a plate-like part extending perpendicularly from the first side wall 13A toward the second side wall 13B, and located between the slit S and the lower edge 14A. The projection 34A is a plate projecting from a bottom edge 33A (lower edge in FIG. 4) of the bottom wall 32A on the side of the bottom wall 12 and extends farther toward the bottom wall 12 (down in FIG. 4) than the lower edge 14A (see also FIG. 1).

Similarly, the second protection wall 31B includes a protection wall body 32B and a projection 34B continuous from the protection wall body 32B. The protection wall body 32B is a plate extending perpendicularly from the second side wall 13B toward the first side wall 13A and located between the slit S and the lower edge 14B. The projection 34B is a plate projecting from a bottom edge 33B (lower edge in FIG. 4) of the bottom wall 32B on the side of the bottom wall 12 and extends farther toward the bottom wall 12 (down in FIG. 4) than the lower edge 14B (see also FIG. 3). The two projections 34A, 34B are adjacent.

The protection walls 31A, 31B prevent the resilient contact piece 21 from being damaged by an external matter by interfering with the external matter trying to move toward the resilient contact piece 21 from the terminal insertion opening 17 of the rectangular tube 11 to restrict this movement.

Further, the projections 34A, 34B prevent the lower edges 14A, 14B of the side walls 13A, 13B from rubbing against an inner surface of a cavity to form streaky scratches by butting against the inner surface of the cavity when the terminal fitting 1 is inclined obliquely inside the cavity of a connector housing (not shown).

On the first protection wall 31A, a facing edge 35A facing the second protection wall 31B is inclined obliquely with respect to a line L perpendicular to the bottom wall 12 over the entire length, as shown in FIG. 4. More specifically, the facing edge 35A is inclined to approach from the second side wall 13B toward the first side wall 13A to approach the bottom wall 12. On the second protection wall 31B, a facing edge 35B facing the first protection wall 31A similarly is inclined obliquely with respect to the line L perpendicular to the bottom wall 12 over the entire length. More specifically, the facing edge 35B extends at a short distance from and parallel to the facing edge 35A of the first protection wall 31A and is inclined in conformity with the inclination of the facing edge 35A (to approach from the second side wall 13B toward the first side wall 13A at positions closer to the bottom wall 12.

As shown in FIG. 1, the connecting portion 40 includes a bottom plate 41 extending from the other end (end part opposite to a side where the terminal insertion opening 17 is open) of the rectangular tube 11 and two pairs of barrels 42, 43 extending from the bottom plate 41. The barrels 42, 43 are crimped to one end part of the wire (not shown) to connect the terminal fitting 1 and the wire.

In connecting this terminal fitting 1 to the male terminal fitting, the tab T is inserted into the rectangular tube 11 through the clearance between the ceiling wall 15 and the protection walls 31A, 31B, as shown in FIG. 3. As the tab T is inserted into the rectangular tube 11, the tab T comes into contact with the contact portion 21C of the resilient contact piece 21 to press the resilient contact piece 21 down. In this way, the auxiliary spring piece 22 also is pressed down to deflect and deform down. As a result, resilient forces from the resilient contact piece 21 and the auxiliary spring piece 22 act on the tab T, and the tab T is sandwiched between the pressure receiving portion 24 and the contact portion 21C of the resilient contact piece 21. In this way, the terminal fitting 1 and the male terminal fitting are connected electrically.

External matter may hit the one end part of the rectangular tube 11 from the side of the bottom wall 12 (from below in FIG. 4). Thus, an external force acts on the protection walls 31A, 31B in a direction from the bottom wall 12 toward the ceiling wall 15 (direction of a thick arrow of FIG. 4) and the protection walls 31A, 31B are going to be deformed from the bottom wall 12 toward the ceiling wall 15.

Figure 6:
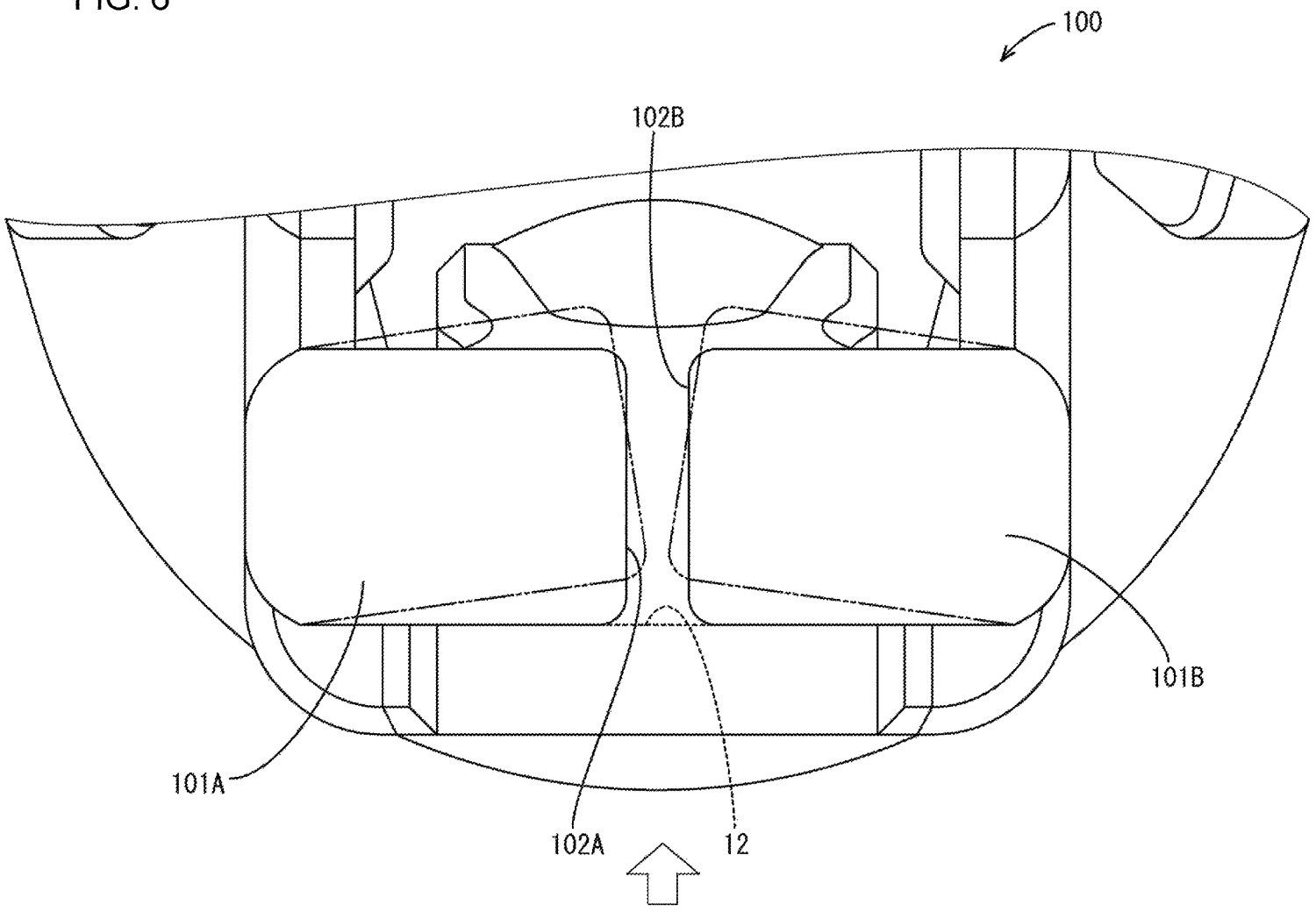
FIG. 6 is a partial enlarged view of a conventional terminal fitting.

If facing edges 102A, 102B of a pair of protection walls 101A, 101B extend perpendicular to the bottom wall 12 (vertical direction of FIG. 6) as in a conventional terminal fitting 100 shown in FIG. 6, the facing edges 102A, 102B extending along a direction in which an external force acts (direction of a thick arrow of FIG. 6) are less likely to interfere with each other and the deformation of the protection walls 101A, 101B is less likely to be suppressed, such as when external matter hits from the side of the bottom wall 12 (from below in FIG. 4).

In contrast, in this embodiment, the facing edges 35A, 35B of the protection walls 31A, 31B are inclined obliquely with respect to the line L perpendicular to the bottom wall 12. In other words, since the facing edges 35A, 35B are oblique with respect to a direction in which an external force acts, i.e. in a direction in which the protection walls 31A, 31B are going to be deformed, the facing edge 35A of the one protection wall 31A interferes with the facing edge 35B of the other protection wall 31B to restrict any further deformation of the protection walls 31A, 31B.

As described above, the terminal fitting 1 includes the rectangular tube 11 composed of the bottom wall 12, the two side walls 13A, 13B rising from the bottom wall 12 and the ceiling wall 15 continuous from the side wall 13B and disposed to face the bottom wall 12. The rectangular tube 11 has the terminal insertion opening 17 on one end, and the tab T of the male terminal fitting is insertable into the terminal insertion opening 17. The resilient contact piece 21 in the form of a leaf spring is arranged along the bottom wall 12 inside the rectangular tube 11. The first and second protection walls 31A, 31B extend respectively from the first and second side walls 13A, 13B and are arranged to close the terminal insertion opening 17, while leaving the clearance for allowing the entrance of the tab T between the ceiling wall 15 and the protection walls 31A, 31B. The protection walls 31A, 31B include the facing edges 35A, 35B facing the mating protection walls 31B, 31A, and the facing edges 35A, 35B obliquely extend with respect to the line L perpendicular to the bottom wall 12.

External matter may hit the rectangular tube 11 from the side of the bottom wall 12, and an external force acts on the protection walls 31A, 31B in the direction from the bottom wall 12 toward the ceiling wall 15 and the protection walls 31A, 31B are going to be deformed in the direction from the bottom wall 12 toward the ceiling wall 15. However, the facing edges 35A, 35B of the protection walls 31A, 31B are at an angle to the line L perpendicular to the bottom wall 12, i.e. the direction in which the external force acts. Thus, the facing edge 35A of the first protection wall 31A interferes with the facing edge 35B of the second protection wall 31B. In this way, the deformation of the protection walls 31A, 31B can be suppressed against an external force applied in the direction from the bottom wall 12 toward the ceiling wall 15 and the resilient contact piece 21 can be protected reliably.

The facing edges 35A, 35B are oblique to the line L perpendicular to the bottom wall 12 over the entire lengths. Thus, deformation of protection walls can be suppressed by simple shapes and complication of a manufacturing process is avoided.

Figure 5:
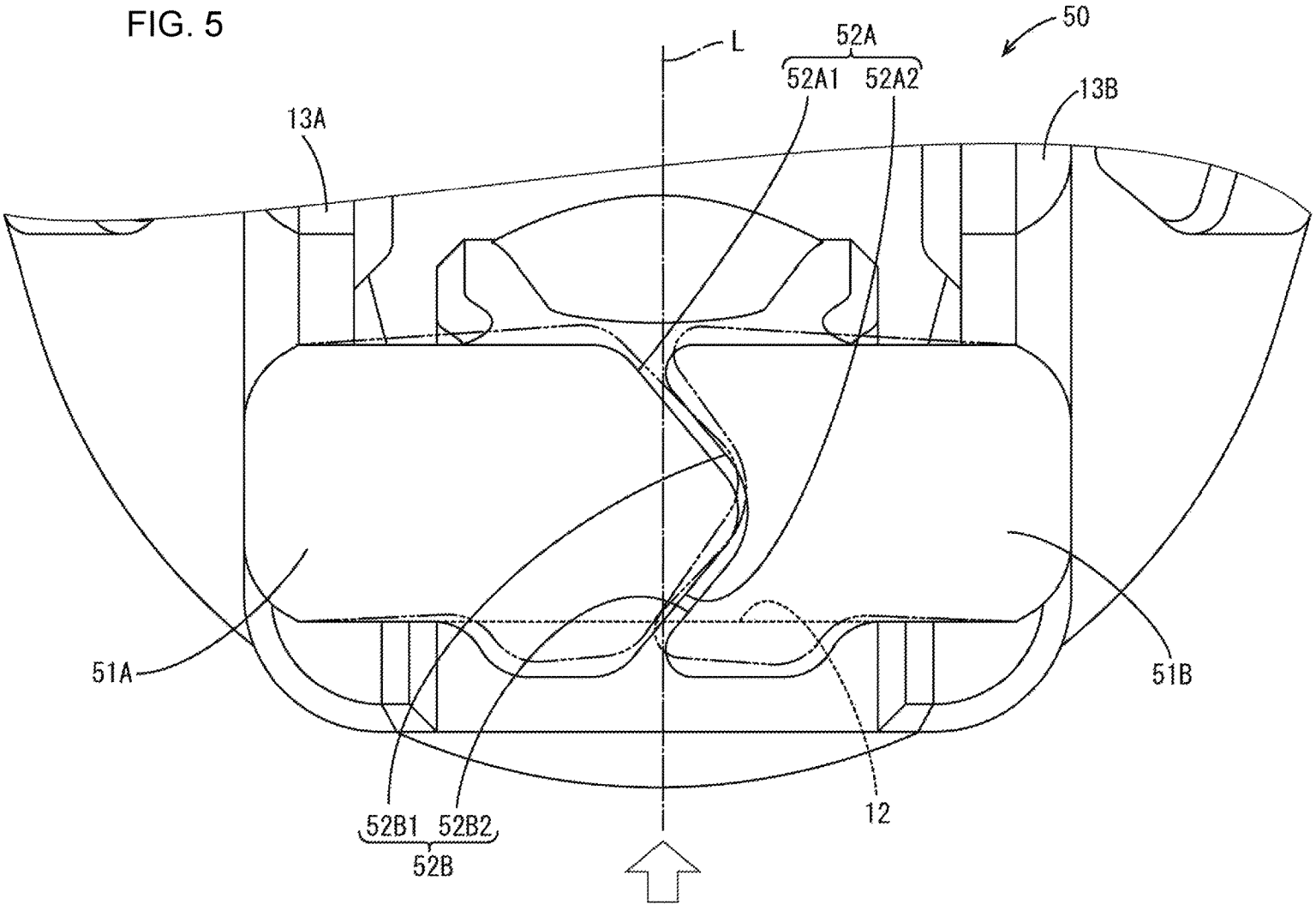
FIG. 5 is a partial enlarged view of a terminal fitting according to a modification.

A terminal fitting 50 of a modification is different from the embodiment in the shapes of the first and second protection walls 51A, 51B as shown in FIG. 5.

As in the embodiment, the first protection wall 51A is a plate extending perpendicularly from the first side wall 13A, and the second protection wall 51B is a plate extending perpendicularly from second side wall 13B. The protection walls 51A, 51B are arranged to close a substantially half of a terminal insertion opening 17 on the side of a bottom wall 12, leaving a clearance for entrance of a tab (T) between a ceiling wall 15 and the protection walls 51A, 51B.

The first protection wall 51A has a facing edge 52A facing the second protection wall 51B and has a half on the side of the ceiling wall 15 (upper part 52A1) and a half on the side of the bottom wall 12 (lower part 52A2). The upper part 52A1 and the lower part 52A2 are inclined in directions opposite to each other with respect to a line L perpendicular to the bottom wall portion 12. More specifically, the upper part 52A1 of the facing edge 52A is inclined to approach from the first side wall 13A toward the second side wall 13B as coming closer to the bottom wall portion 12, and the lower part 52A2 thereof is inclined to approach from the second side wall 13B toward the first side wall 13A while coming closer to the bottom wall 12. The facing edge 52A has a chevron shape convex toward the mating protection wall 51B as a whole.

On the second protection wall 51B, a facing edge 52B facing the first protection wall 51A extends at a short distance from and is parallel to the facing edge 52A of the one protection wall 51A while being inclined in conformity with the facing edge 52A. More specifically, a half of the facing edge 52B on the side of the ceiling wall 15 (upper part 52B1) is inclined to approach from the first side wall 13A toward the side wall 13A while approaching the bottom wall 12, and a half of the facing edge 52B on the side of the bottom wall 12 (lower part 52B2) is inclined to approach from the side wall 13B toward the first side wall 13A while approaching the bottom wall 12. The facing edge 52B has a valley shape concave toward the mating protection wall 51B.

Since other components are similar to those of the first embodiment, the components similar to those of the first embodiment are denoted by the same reference signs and not described.

Even in such a configuration, if an external force acts on the protection walls 51A, 51B in a direction from the bottom wall 12 toward the ceiling wall 15 (direction of a thick arrow of FIG. 5), the facing edge 52A of the first protection wall 51A interferes with the facing edge 52B of the second protection wall 51B to restrict any further deformation of the protection walls 51A, 51B. Particularly, since a chevron-shaped part of the first protection wall 51A is fit into a valley-shaped part of the second protection wall 51B in this modification, the deformation of the protection walls 51A, 51B can be restricted reliably.

The invention is not limited to the above described and illustrated embodiment. For example, the following modes are also included.

Although the entire facing edges 35A, 35B are oblique to the line L perpendicular to the bottom wall 12 in the above embodiment, only parts of facing edges may be, for example, oblique to a line perpendicular to a bottom wall.

The facing edges 35A, 35B are oblique to the line L perpendicular to the bottom wall 12 in the above embodiment. However, facing edges may be stepped and have parts extending perpendicular to a line perpendicular to a bottom wall.

The entire facing edge 52A of the first protection wall 51A constitutes one chevron shape and the entire facing edge 52B of the other protection wall 51B constitutes one valley shape in the modification. However, a facing edge of one protection wall may have plural chevron-shapes and a facing edge of the other protection wall may have a plurality of valley-shaped parts in conformity with the chevron-shaped parts of the facing edge of the one protection wall.

REFERENCE SIGNS 1, 50 . . . terminal fitting
11 . . . rectangular tube
12 . . . bottom wall
13A, 13B . . . sidewall
15 . . . ceiling wall
17 . . . terminal insertion opening
21 . . . resilient contact piece
31A, 31B, 51A, 51B . . . protection wall
35A, 35B, 52A, 52B . . . facing edge

What is claimed is:

1. A terminal fitting to be connected to a mating terminal fitting with a tab, comprising:

a rectangular tube composed of a bottom wall, first and second side walls rising from the bottom wall and spaced apart in a width direction of the rectangular tube, and a ceiling wall extending between the first and second side walls and facing the bottom wall, the rectangular tube including an opening on one end, the tab being insertable into the opening;

a resilient contact piece in the form of a leaf spring arranged along the bottom wall inside the rectangular tube;

a first protection walls extending from the first side wall towards the second side wall and having a first facing edge spaced from the first side wall, the first facing edge including at least one oblique portion inclined obliquely with respect to the first and second side walls; and a second protection wall extending from the second side wall towards the first side wall, and having a second facing edge spaced from the second side wall, the second facing edge including at least one oblique portion inclined obliquely to the second side wall and parallel to the oblique portion of the first facing edge, wherein the at least one oblique portion of the first facing edge and the at least one oblique portion of the second facing edge at least partially overlap each other in the width direction of the rectangular tube.

2. The terminal fitting of claim 1, wherein the facing edge is inclined obliquely over an entire length thereof.

3. The terminal fitting of claim 1, wherein a part of the facing edge toward the ceiling wall and a remaining part toward the bottom wall are inclined in opposite directions with respect to a line perpendicular to the bottom wall.

* * * * *